US008317527B2

(12) United States Patent
Vitale

(10) Patent No.: US 8,317,527 B2
(45) Date of Patent: Nov. 27, 2012

(54) ELECTRICAL PLUG WITH REPLACEABLE PRONG HAVING A WEAKENED SECTION OUTSIDE THE PLUG BODY

(76) Inventor: Al Vitale, Guilford, CT (US)

( * ) Notice: Subject to any disclaimer, the term of this patent is extended or adjusted under 35 U.S.C. 154(b) by 0 days.

(21) Appl. No.: 13/097,927

(22) Filed: Apr. 29, 2011

(65) Prior Publication Data

US 2011/0269352 A1 Nov. 3, 2011

Related U.S. Application Data

(60) Provisional application No. 61/329,240, filed on Apr. 29, 2010.

(51) Int. Cl.
*H01R 13/648* (2006.01)

(52) U.S. Cl. ..... 439/103

(58) Field of Classification Search ..... 439/103, 439/104, 106, 108, 457
See application file for complete search history.

(56) References Cited

U.S. PATENT DOCUMENTS

| | | | | |
|---|---|---|---|---|
| 2,984,808 | A | 5/1961 | Bender | |
| 3,299,390 | A | 1/1967 | Eckelkamp | |
| 3,531,757 | A | 9/1970 | Alden | |
| 3,546,650 | A | 12/1970 | Purer | |
| 3,739,317 | A | 6/1973 | Wise | |
| 4,078,848 | A | 3/1978 | Blairsdale | |
| 4,081,206 | A * | 3/1978 | Lee | 439/104 |
| 4,201,431 | A | 5/1980 | McDonald | |
| 5,213,516 | A | 5/1993 | Okamoto | |
| 6,287,131 | B1 | 9/2001 | Deng | |
| 6,419,504 | B1 | 7/2002 | Nelson | |
| 7,513,782 | B1 | 4/2009 | Sheldon et al. | |

* cited by examiner

*Primary Examiner* — Chandrika Prasad
(74) *Attorney, Agent, or Firm* — St. Onge Steward Johnston & Reens LLC

(57) ABSTRACT

An electrical plug with a user-replaceable prong, which includes a body and current-carrying prongs, at least one of which is removable. The removable prong includes a weakened portion positioned outside of the body when the removable prong is seated in the body of the plug. The weakened portion is designed to be the point at which the prong is most likely to break and is located so that the removable prong will be easy to remove from the body even after breaking.

20 Claims, 5 Drawing Sheets

ELECTRICAL PLUG WITH REPLACEABLE PRONG HAVING A WEAKENED SECTION OUTSIDE THE PLUG BODY

CROSS-REFERENCE TO RELATED APPLICATIONS

The present application claims the benefit under 35 U.S.C. §119(e) of U.S. Provisional Patent Application Ser. No. 61/329,240 filed on Apr. 29, 2010.

FIELD OF THE INVENTION

The present invention relates generally to an electrical plug with a replaceable prong, and more specifically, relates to a user-replaceable prong on an electrical plug with a weakened area on the prong.

BACKGROUND OF THE INVENTION

A standard electrical plug has either two or three prongs attached to the plug. In a two-prong plug, one prong is live, and carries the current from the source to the load. The other prong is neutral, which returns the current to the source. The live prong and the neutral prong may be of the same size, or they may be different sizes to ensure that the live prong and the neutral prong match the corresponding receptacles in a wall outlet.

A three-prong plug is similar to a two-prong plug in that it includes a live prong and a neutral prong. However, a three-prong plug also includes a ground prong. The ground prong connects the electrical device to earth ground, which is intended to protect against insulation failure of the connected device, such as when a live wire unexpectedly delivers current to an exposed metal part of the device. The ground connection permits such current to be safely handled. Connections to ground also limit the build-up of static electricity on parts of the device, which can be important in the presence of flammable products or when repairing the device. In some power transmission circuits, the earth itself can be used as one conductor of the circuit, saving the cost of installing a separate return conductor.

A three-prong plug provides many advantages over a standard two-prong plug. However, the corresponding three-prong outlet, necessary when using a three-prong plug, has only recently become commonly used in the construction of housing. It was common practice in older homes to install two-prong outlets instead of the grounded three-prong outlets. In many cases, the cost of upgrading all of the electrical outlets to three-prong outlets is prohibitive, partly due to the requirement that a continuous grounding wire would need to be run to all outlets.

Rather than upgrade the electrical outlets, many users of electrical devices use a ground lifting plug. A ground lifting plug is a plug with a three-prong receptacle on one side, and a two-prong plug on the other side. This turns a three-prong plug into a two-prong plug, allowing a user to install an electrical device with three-prongs, in older homes. The problem with using a ground lifter is that a user would need a ground lifter for each three-prong plug he/she wants to add into a two-prong outlet. Ground lifters are generally of an unattractive gray color, and add significant length to the plug, preventing items from being placed flush against the wall.

A second significant problem with typical three prong plugs used today, is that the ground prong tends to be less sturdy than the live prong and the neutral prong. The live and neutral prongs are of a thin rectangular shape. They can be bent slightly along a single axis without breaking, and the shape prevents any bending in a perpendicular axis. The ground prong, however, is of a generally cylindrical shape, and can bend, and even break off by movement in any direction. For example, a user removing a three-prong plug from an outlet, may inadvertently break the ground prong by removing the three-prong plug at too steep of an angle. If the ground prong breaks, the entire plug, and or wire plug set would need to be replaced. This can be very expensive, time consuming, and difficult to do.

U.S. Pat. No. 3,531,757 to Alden discloses a plug with a user-replaceable ground prong, which has a groove that is held in place by two indentations inside the body of the plug by means of an interference fit. A disadvantage of this device is that the indentations are susceptible to wear and tear if the ground prong is removed and replaced in the body and/or if the plug is removed and replaced from an outlet on a regular basis. The indentations may lose the ability to hold the ground prong, which may result in the ground prong remaining inside of the electrical outlet when the plug is removed. Additionally, if the user bends the plug at too steep of an angle when removing the plug from an outlet, the ground prong may break, and it is possible that the ground prong will break off at a portion inside of the plug body. This would render the plug useless as a user would not be able to remove the ground prong from the plug body to be able to replace it.

U.S. Pat. No. 6,419,504 to Nelson discloses a plug with a ground conductor that can be slid in and out of the plug body. A switch on the plug body allows the user to lock the ground prong in place in either an extended position outside of the plug body or a retracted position inside of the plug body. A disadvantage of this device is that the ground prong is not user replaceable. If the ground prong were to break, easy replacement of the ground prong it is not possible, rendering the plug useless for its intended purpose.

U.S. Pat. No. 3,739,317 to Wise discloses a plug with a reconfigurable ground prong. In one embodiment, the ground prong is retractable and has grooves that engage an external fastener in either an extended or retracted position. A clear disadvantage of this design is that, if the ground prong were to break, it would most likely break at the innermost groove, which is inside the plug body, making it extremely difficult to remove the remainder of the prong for replacement.

Additionally, prongs having a generally cylindrical shape are used in a variety of other circumstances. For example, plugs used in many European countries have prongs that are generally cylindrical and susceptible to breakage. Such plugs are also expensive to replace in the event of breakage of one of the prongs.

What is desired, therefore, is an electrical plug with a replaceable prong that that can be easily removed and replaced in the event of breakage. More particularly, what is desired is an electrical plug with a replaceable ground prong that allows the plug to be easily used in either a two-prong or a three-prong configuration. It is also desired that the plug be configured such that, in the event of breakage, the remainder of the ground prong can still be easily removed from the body of the plug. It is further desired that the plug be inexpensive and simple to manufacture.

SUMMARY OF THE INVENTION

The invention is directed to an electric plug with a user-replaceable prong having a weakened portion. The weakened portion creates a portion on the prong that is more susceptible to breakage than any other portion on the prong. The placement of the weakened portion outside of the body of the plug allows the user to always be able to replace the prong in the event that the prong breaks. In general, according to the invention, the weakened portion is placed on the prong in a place that ensures that the weakened portion will be the location of any breakage and that will make subsequent removal of the broken prong easy for a user of the prong. In exemplary embodiments of the invention, the weakened portion is located on the half of the portion of the exposed prong that is nearest the body of the plug.

According to a first embodiment of the present invention, an electrical plug is provided, comprising a body, a first current-carrying prong, a second current-carrying prong, a threaded ground connector disposed in the body, and a removable ground prong. The removable ground prong has a first end and a second end. The first end includes a threaded portion adapted to engage the threaded ground connector. The second end is adapted to engage a ground receptacle. The removable ground prong includes a weakened portion positioned outside of the body and near the first end when the ground prong is seated in the threaded ground connector.

In some embodiments of the present invention, the weakened portion is a notch. In some embodiments of the present invention, the notch extends around an entire circumference of the removable ground prong. In some embodiments of the present invention, the notch extends around a portion of the circumference of the removable ground prong. In some embodiments of the present invention, the weakened portion is positioned between about 1/32" and 1/2" from the body when the removable ground prong is seated in the threaded ground connector.

According to another embodiment of the present invention, an electrical plug is provided comprising a body, a connector disposed in the body, and a removable prong. The removable prong has a first end and a second end. The first end is adapted to engage the connector and the second end is adapted to engage an outlet receptacle. The removable prong includes a weakened portion positioned near the first end and outside of the body when the removable prong is seated in the connector.

In some embodiments, the plug further comprises at least one additional prong. In some embodiments, the removable prong is secured in the connector by an interference fit. In some embodiments, the removable prong is secured in the connector by a pin that engages the removable prong. In some embodiments, the removable prong includes a threaded portion that engages corresponding threads on the connector. In some embodiments, the weakened portion is a notch. In some embodiments, the notch extends around an entire circumference of the removable prong. In some embodiments, the notch extends around a portion of a circumference of the removable prong. In some embodiments, the weakened portion is positioned between about 1/32" and 1/2" from the body when the removable is seated in the connector.

According to another embodiment, an electrical plug is provided comprising a body, a first current-carrying prong, a second-current carrying prong, a threaded ground connector disposed in the body, and a removable ground prong having a first end and a second end. The first end includes a threaded portion adapted to engage the threaded ground connector, and the second end is adapted to engage a ground receptacle. The removable ground prong includes a weakened portion in the form of a notch positioned outside of the body and near the first end when the removable ground prong is seated in the threaded ground connector.

In some embodiments, the notch extends around an entire circumference of the removable ground prong. In some embodiments, the notch extends around a portion of a circumference of the removable ground prong. In some embodiments, the weakened portion is positioned between about 1/32" and 1/2" from the body when the removable ground prong is seated in the threaded ground connector.

According to a fourth embodiment, a current carrying prong is provided, comprising a first end for engaging a ground connector in an electrical plug, a second end for engaging a ground receptacle in an electrical outlet, and a weakened portion near said first end. In some embodiments, the first end includes a threaded portion for engaging corresponding threads in a ground connector. In some embodiments, the weakened portion is in the form of a notch.

DETAILED DESCRIPTION OF THE INVENTION

Figure 1A:
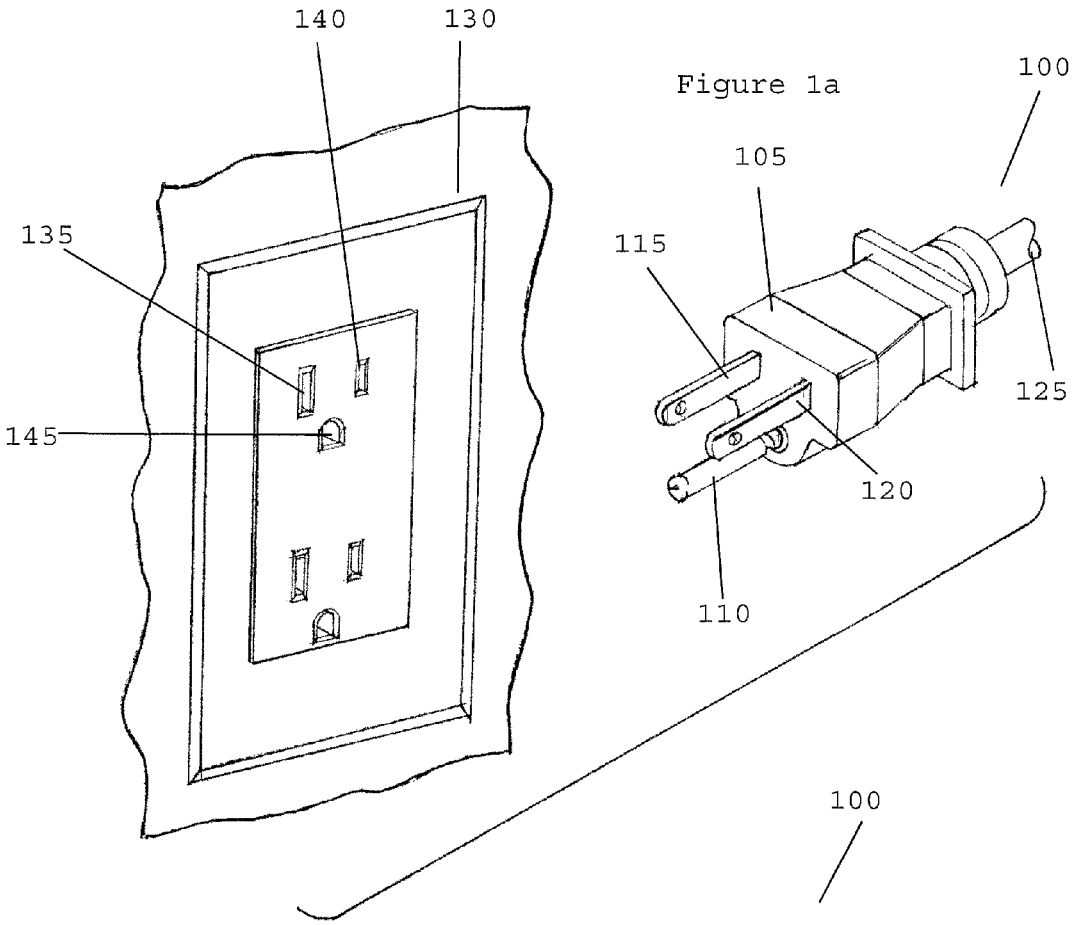
FIG. 1*a-b* is a perspective view of an electrical outlet and a three-prong electrical plug according to an embodiment of the present invention.

The exemplary embodiments of the present invention may be further understood with reference to the following description and the related appended drawings, wherein like elements are provided with the same reference numerals. The exemplary embodiments of the present invention are related to a three-prong electrical plug with a removable ground prong that has a weakened portion that meets all OSHA standards. The exemplary embodiments are described with reference to a standard three-prong electrical plug, but those skilled in the art will understand that the present invention may be implemented on any electrical wire having a plug with current-carrying prongs. Those skilled in the art will understand that the present invention is not limited to use on a ground prong, but is advantageous on any suitable prong of an electrical plug.

Figure 1B:
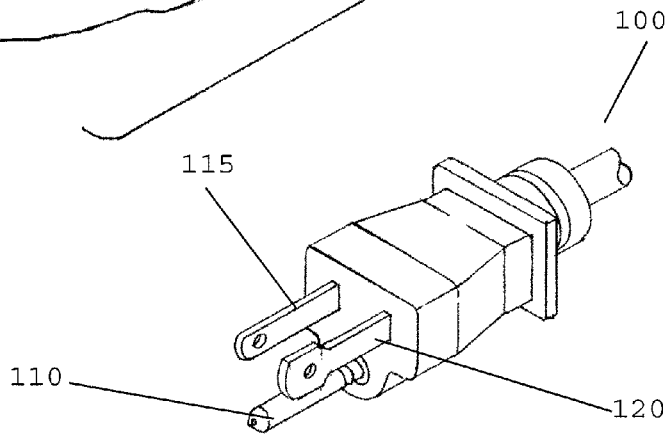

As best seen in FIGS. 1*a-b*, perspective views of an electrical plug 100 and an electrical outlet 130 are shown. Electrical plug 100 is similar to a standard three-prong electrical plug. Electrical plug has a body 105, preferably made from a molded plastic or similar material. Electrical plug 100 has a first prong 115 adapted to fit into a first slot 140 of electrical outlet 130. Generally, first prong 115 is connected to the live, or hot wire, which carries electrical current from the source of electrical power. The electric current, generally from a power company, flows through first prong 115 into first slot 140 when electrical plug 100 is inserted into electrical outlet 130. Electrical plug 100 has a second prong 120 adapted to fit into a second slot 135 of electrical outlet 130. Generally, second prong 120 is the neutral wire, which completes the circuit. In many cases, second prong 120 is of the same size and shape as first prong 115 (FIG. 1*a*). However, second prong 120 may be of a size bigger than first prong 115 as shown in FIG. 1*b*. In cases where second prong 120 is bigger than first prong 115 in a two-prong plug, this ensures that the first prong 115 is always connected to first slot 140 and second prong 120 is connected to second slot 135, which ensures that the hot and neutral wires are connected correctly.

Electrical plug 100 has a third, or ground, prong 110 extending from body 105. Ground prong 110 is of a substantially cylindrical shape, and is longer than first prong 115 and second prong 120, such that the ground prong makes an electrical connection in the electrical outlet before the prongs 115 and 120. This allows the electrical device to be grounded prior to the introduction of current through the live prong 115, preventing any electrical surges during insertion of the plug. In other embodiments, the ground prong has a shape that deviates somewhat from that of a cylinder, e.g., wherein the cylinder has a flattened face.

Ground prong 110 is adapted to fit in ground receptacle 145 of electrical outlet 140. A ground prong is generally used in devices with exposed metal. Ground prong 110 connects the exposed metallic portions of the device to earth ground. Connecting the metallic portions of a device to earth ground protects the users of the device in the event of an internal failure of the device such that current begins to flow through the exposed metal. The ground prong allows for a circuit breaker to detect a build-up of electricity in the exposed metallic portions of the device.

Figure 2:
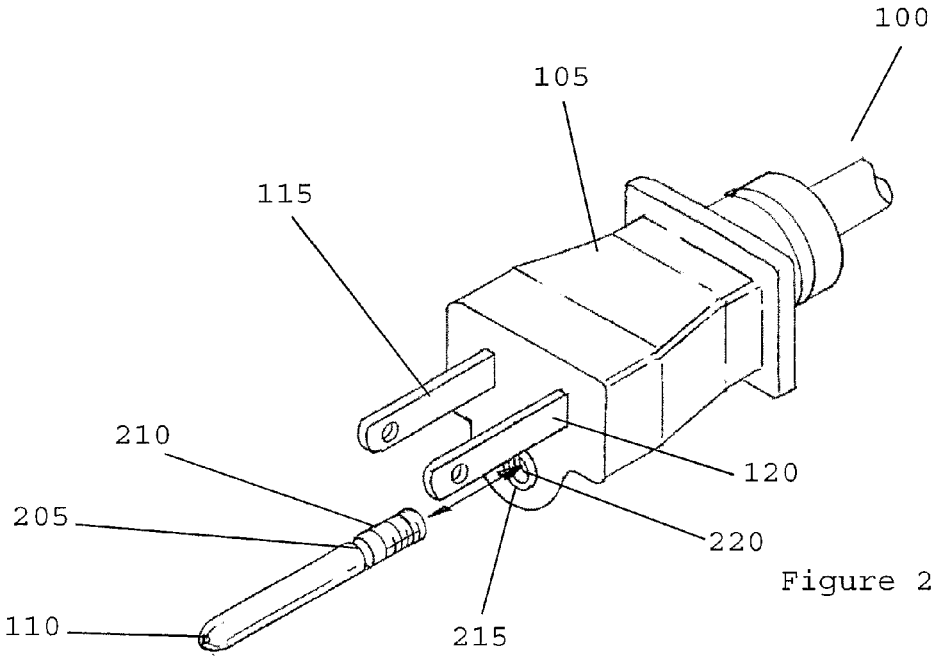
FIG. 2 is an exploded perspective view of the three-prong electrical plug of FIG. 1.

As best seen in FIG. 2, an exploded view of electrical plug 100 is shown. Electrical plug 100 includes a body 105 with first prong 115 and second prong 120 permanently extending therefrom. Ground prong, 110, however, may be removed from body 105 of electrical plug 100. Ground prong 110 is connectable to body 105 by inserting ground prong 110 into ground connector 215. Ground connector 215 has internal threads 220, which correspond to external threads 210 on ground prong 110. To install ground prong 110, a user inserts ground prong 110 into ground connector 215, and rotates ground prong 110 until ground prong 110 has been completely seated and is snug inside ground connector 215. A user may use their hands to rotate ground prong 110 or a user may use a pair of pliers, or similar tool, to rotate ground prong 110. To remove ground prong 110 from body 105, the user rotates ground prong 110 in a direction opposite to the direction used for insertion. Once ground prong 110 is no longer engaged with internal threads 220, ground prong 110 may be removed. In some embodiments, ground prong 110 has an indentation (not shown in the Figures) at the end of ground prong 110 corresponding to a flat head, Phillips head, or similar type of tool indentation. This can facilitate easy insertion and removal of ground prong 110 from body 105 without damaging the ground prong 110.

A user of electrical plug 100 may remove ground prong 100 if no three-prong electrical outlet is available. Instead of using a standard ground lifter, the user can simply remove ground prong 110 from body 105, and insert electrical plug 100 into a two-prong electrical outlet. This saves money as a ground lifter need not be purchased; this saves space as a ground lifter can be over two inches long; this also saves the person time as they do not have to search for a ground lifter, or have to go out and purchase one if they do not have one.

In addition to removing ground prong 110 when only a two-prong plug is available, a user may wish to remove ground prong 110 if ground prong 110 is broken. First prong 115 and second prong 120 are of a long thin design, preventing motion in one direction, and providing for bending in a perpendicular direction. This makes it difficult for first prong 115 and second prong 120 to be broken. In contrast, ground prong 110 is generally cylindrical, and is not bendable in any direction. This makes ground prong 110 susceptible to breakage. For example, a user that removes electrical plug 100 at too steep of an angle may break off ground prong 110 inside of ground receptacle 145. In the above case, the user would need to replace the broken ground prong 110 with a non-broken ground prong.

If ground prong 110 breaks at a location outside of body 105 then the replacement of ground prong 110 may be easy. However, ground prong 110 is particularly susceptible to breakage at the surface of body 105. However, if ground prong 110 breaks off at the surface of body 105, the user will not be able to remove the broken ground prong because he or she would not be able to grip the prong in order to unscrew it. This would leave the device without a way to ground the exposed metallic portions of the device, which could potentially lead to a dangerous situation for the user of the device. To prevent ground prong 110 from breaking at the surface of body 105, ground prong 110 has a weakened portion 205. Weakened portion 205 may be in the form of a notch, and is located near the side of ground prong 110 that is inserted into body 105. Weakened portion 205 creates a point that is more susceptible to breakage than any other point on ground prong 110. In the event of a bending of ground prong 110 sufficient to cause breakage, weakened portion 205 would ensure that the breakage would occur at a location that is outside of, or not at the surface of, body 105. This would enable the user to always be able to remove and replace ground prong 110, since he or she would be able to grip a part of the prong that is protruding outside of body 105.

In some embodiments, ground prong 110 is made of a solid piece of metal, and weakened portion 205 may be formed by removing a portion of the metal around the entire circumference of ground prong 110. A solid piece of metal would create a strong and stable ground prong. The inclusion of a notch of removed metal as the weakened portion would create a structural weakness that would be more likely to fail than any other portion on ground prong 110. In such a situation, the weakened portion could be formed by any suitable means, such as grinding, sawing, etching, etc.

In some embodiments, ground prong 110 is made from a hollow piece of metal and weakened portion 205 is formed by partially bending the metal of ground prong 110 to form a semi-circular indent in ground prong 110. This creates a structurally weaker area at weakened portion 205, which would cause a breakage of ground prong 110 to occur at weakened portion 205.

Figure 3A:
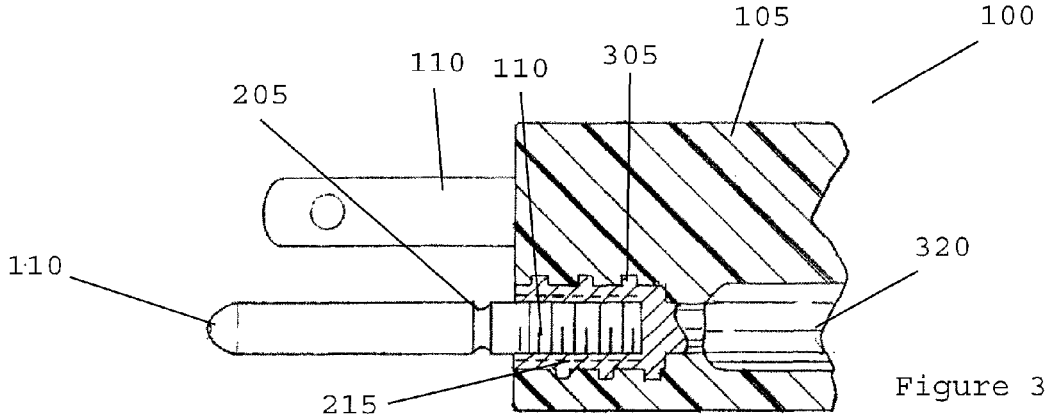
FIG. 3*a* is a partial cross-sectional view of the three-prong electrical plug of FIG. 1.
Figure 3B:
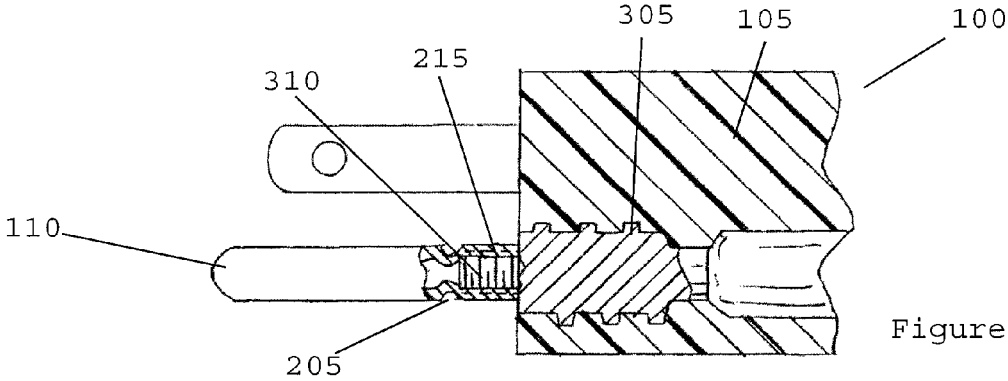
FIG. 3*b* is a partial cross-sectional view of a three-prong electrical plug according to another embodiment of the present invention.

As best seen in FIGS. 3*a-b*, a partial cross-sectional view of electrical plug 100 is shown. Conductor 320 is one of the conductors from wire 125. Wire 125 consists of three conductors corresponding to the hot prong, the neutral prong, and the ground prong. The end of conductor 320 is housed inside of body 105 and terminates at connector 215. Connector 215 may have external threads 305 to grip inside of body 105, however, connector 215 may be held inside body 105 by any known means. Connector 215 also has interior threading 220, which can be engaged by the threads on ground prong 110. In FIG. 3*a*, connector 215 is housed completely inside of body 105. This requires that connector 215 has internal threads 220, and requires ground prong 110 to have external threads 210.

FIG. 3*b* shows connector housed partially inside of body 105. Connector 215 has an exterior portion 310 outside of body 105. Exterior portion 310 has external threads to connect to ground prong 110. Ground prong 110 has corresponding internal threads 215 on the inside of ground prong 110 such that ground prong 110 fits over connector 215, and when ground prong 110 is completely screwed on to connector 215, connector 215 is no longer visible.

Figure 4A:
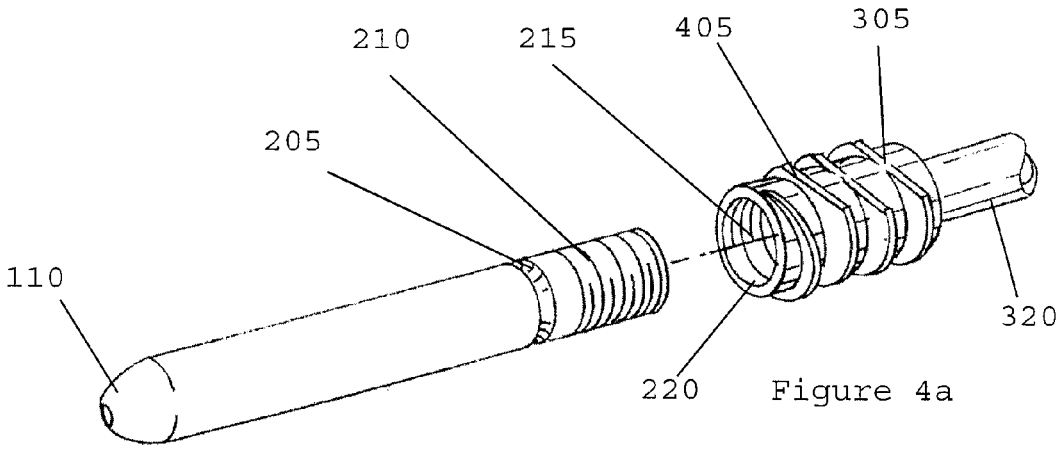
FIG. 4*a* is an exploded view of the ground prong and ground conductor of the three-prong electrical plug of FIG. 1.
Figure 4B:
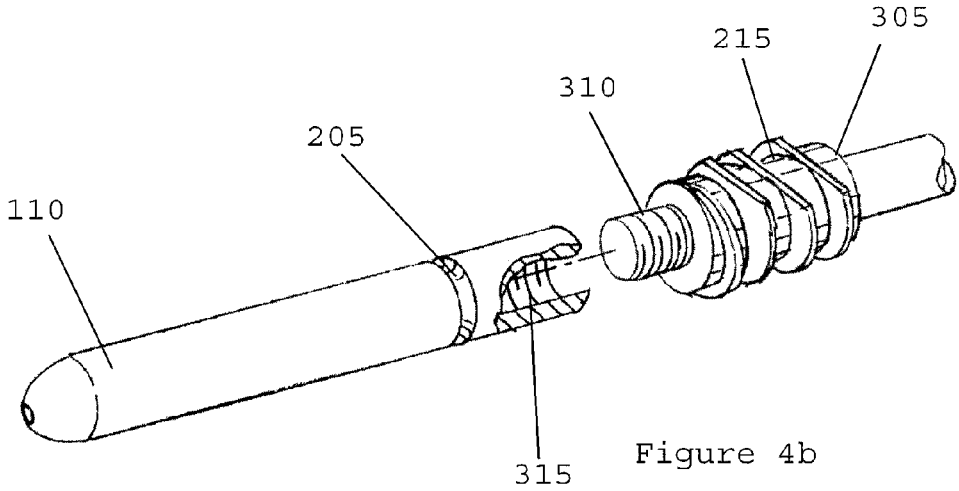
FIG. 4*b* is an exploded view of the ground prong and ground wire of the three-prong electrical plug from FIG. 3*b*.

FIGS. 4*a-b* show an exploded view of ground prong 110, conductor 320, and connector 215. FIG. 4*a* shows connector 215 that is intended to be housed completely inside of body 105. FIG. 4*b* shows connector 215 that is intended to be housed partially inside of body 105. As stated above, the end of conductor 320 is housed inside of body 105, and terminates at connector 215. Connector 215 is shown with external gripping member 405 in the form of threads 305 to grip the inside of body 105. The external threading 305 creates resistance to any pulling of conductor 320, which prevents connector 215 from loosening within body 105. While connector 215 is shown with external threading to grip inside of body 105, it should be noted that any known method for securing connector 215 inside of body 105 can be used.

Figure 5A:
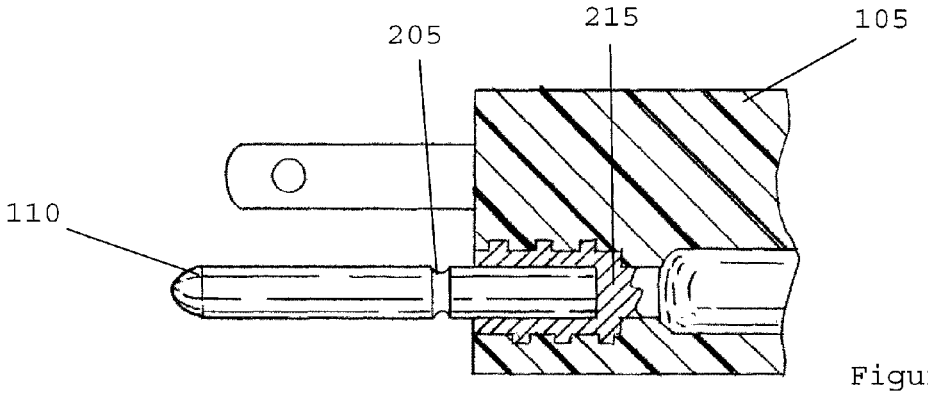
FIG. 5*a-b* are partial cross-sectional views of three-prong electrical plugs with different connections between the ground prong and the ground connection.
Figure 5B:
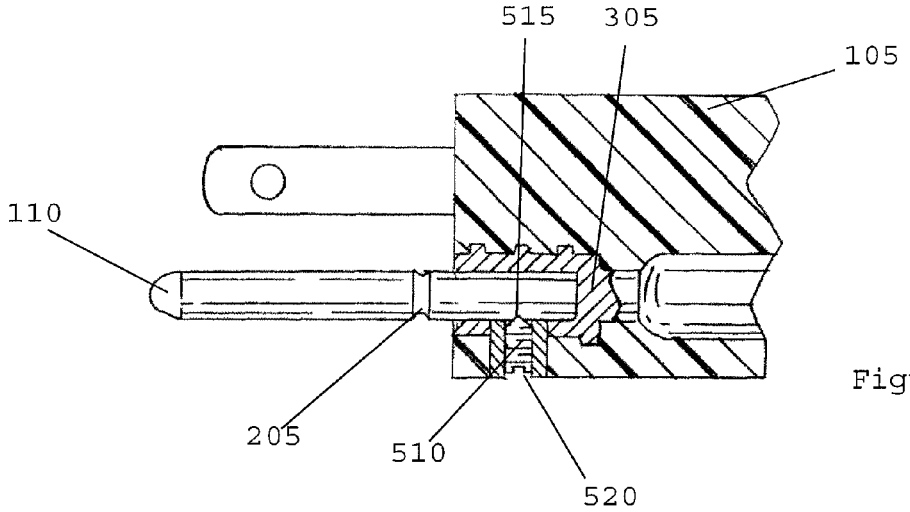

FIGS. 5*a-b* show partial cross-sectional views of electrical plug 100 with different ground connector configurations. In the embodiments described above, ground prong 110 is connected to body 105 using a threaded fitting where ground prong 110 is screwed into body 105. However, ground prong 110 may be connected to body 105 using different means.

FIG. 5*a* shows ground prong 110 connected to body 105 using an interference fit inside ground connector 215. Connector 215 does not have internal or external threads, and ground prong 110 does not have internal or external threads. Ground prong 110 is designed to be held inside of body 105 using a force exerted by connector 215 on the circumference of ground prong 110. This may be accomplished by making the diameter of the hole of connector 215 slightly smaller than diameter of ground plug 110. When ground prong 110 is inserted into connector 215, a certain amount of force is required to expand the diameter of the hole of connector 215. Once ground prong 110 has been pushed inside of connector 215, connector 215 exerts a force around the body of ground prong 110, keeping ground prong 110 inside of body 105 unless a person intentionally removes ground prong 110 from body 105 by exerting a large pulling force on ground prong 110.

FIG. 5*b* shows the use of a retention pin to connect ground prong 110 to body 105. Body 105 has a second hole 520 which may be threaded. In a preferred embodiment, second hole 520 runs perpendicular to the hole in which ground prong 110 is inserted, however, second hole 520 may be at any angle in relation to the hole in which ground prong 110 is inserted. Hole 520 has a screw 510, which when fully tightened, applies pressure on the body of ground prong 110. Screw 510 may be a flat head screw, a Phillips head screw, and Allen wrench screw, or any other known type of screw head.

To install ground prong 110 inside of connector 215, ground prong 110 is inserted inside of connector 215 until ground prong 110 hits the back wall of connector 215 and ground prong 110 cannot be inserted any further. The user screws screw 510 until it is tight, holding ground prong 110 in place. Ground prong 110 may have a notch (Not Shown), which screw 510 screws into, this provides a more secure holding of ground prong 110, however, ground prong 110 need not have a notch, and the force exerted by screw 510 on the exterior surface of the body of ground prong 110 is enough to hold ground prong 110 inside body 105.

Figure 6A:
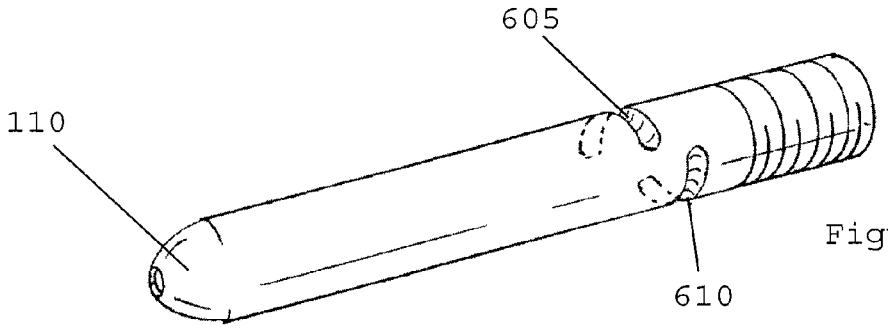
FIG. 6*a-c* are perspective views of ground prongs with different style weakened portions.
Figure 6B:
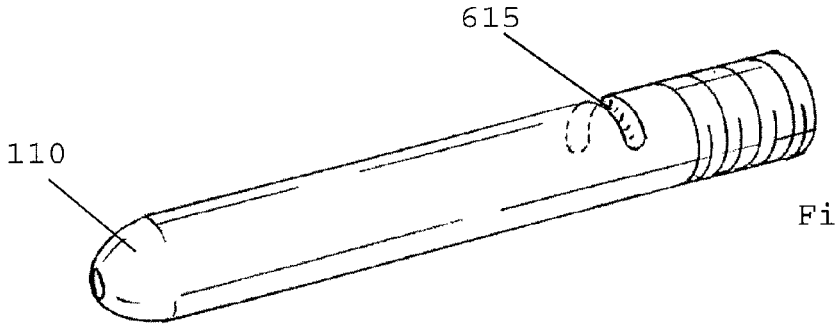
Figure 6C:
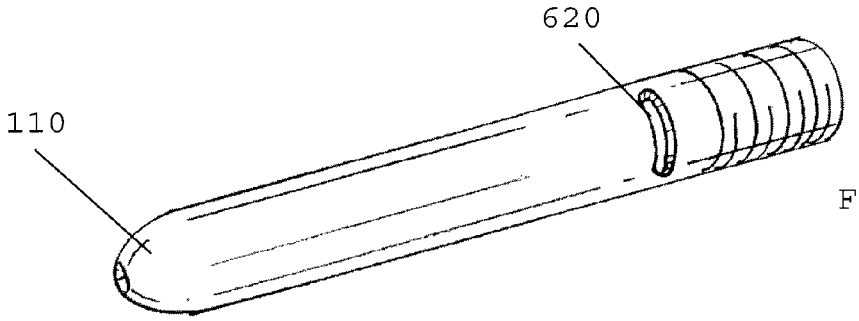

As best seen in FIGS. 6*a-c*, perspective views of ground prongs with different style weakened portions are shown. In the above examples, ground prong 110 is shown having a weakened portion that continuously extends around the entire circumference of ground prong 110. However, in some embodiments, the weakened portion does not extend around the entire circumference of the ground prong 110 in a continuous fashion. FIG. 6*a* shows ground prong 110 having a weakened portion that comprises two notches 605 and 610 at different locations and on different sides of ground prong 110. It should be noted that while FIG. 6*a* shows notch 610 closer than notch 605 to the end of ground prong 110, notch 605 may be closer to the end, and the placement of both notches depends on the expected forces of bending ground prong 110 in different directions.

FIG. 6*b* shows ground prong 110 having a notch 615 extending around a portion of the circumference of ground prong 110. It should be noted that while FIG. 6*b* shows notch 615 extending around approximately half of the circumference of ground prong 110, the notch can extend around any amount of the circumference of ground prong 110.

As stated above, if ground prong 110 is a solid piece of metal, the weakened portion may be a removal of part of the metal. If ground prong 110 is hollow, the weakened portion may be a molded, semi-circular indent. However, if ground prong 110 is hollow, the weakened portion need not be made by molding a semi-circular indent. FIG. 6*c* shows a hollow ground prong 110 having a weakened portion in the form of notch 620 that is a cutout of the metal of ground prong 110. If a person were to examine notch 620 they would be able to see inside of ground prong 110. The remove of some of the metal of the hollow metallic body of ground prong 110 creates a weakened portion at which the ground prong is most likely to break. It should be noted that while FIG. 6*c* shows notch 620 to be less than half the circumference of ground prong 110, notch 620 can be of any size and cover any amount of the circumference of ground prong 110 such that ground prong 110 is still able to maintain its stability and its electrical conductive abilities are not diminished.

There are numerous different ways of forming the weakened portion. These include grinding, sawing, etching, etc. of a preformed ground prong. Also, the formation of the weakened portion may be integral with the fabrication of the prong, so that the weakened portion is formed during the forging, stamping, extrusion, etc. of the prong.

The size of the weakened portion varies between embodiments depending on the material selected for the ground prong, as well as the particular design of the prong and the method by which the prong is fabricated. In an exemplary embodiment, the weakened portion is a notch formed in the prong by means of a saw. The notch is about 1/16" wide, and is located between about 1/32" to about 3/8" from the body 105 of the plug when the prong is seated in the ground connector 215. The width of the notch or weakened portion varies in other embodiments, including any width between about 1/32" and about 3/8". While the placement of the notch or weakened portion also varies in other embodiments, in general, the notch is located anywhere on the half of the exposed portion of the ground prong that is nearest the body 105 of the plug when the prong is seated in the ground connector 215. In some embodiments, this includes anywhere between about 1/32" to about 1/2" from the body 105 of the plug when the prong is seated in the ground connector 215.

This electrical plug has the advantage of a specific weakened portion on the ground prong such that, regardless of the forces exerted on the ground prong, it is designed to fail at a particular, convenient point. This ensures that when a break in the ground prong occurs, it will always occur outside of the body of the electrical plug to facilitate easy removal and replacement of the prong.

It will be appreciated by those skilled in the art that various changes and modification can be made to the illustrated embodiment without departing from the spirit of the invention. All such modification and changes are intended to be covered hereby.

What is claimed is:

1. An electrical plug comprising:

a body;

a first current carrying prong;

a second current carrying prong;

a threaded ground connector disposed in said body;

a removable ground prong having a first end and a second end, wherein said first end includes a threaded portion adapted to engage the threaded ground connector and the second end is adapted to engage a ground receptacle; and wherein said removable ground prong includes a weakened portion positioned outside said body and near said first end when said removable ground prong is seated in said threaded ground connector.

2. The electrical plug of claim 1, wherein said weakened portion is a notch.

3. The electrical plug of claim 2, wherein said notch extends around an entire circumference of said removable ground prong.

4. The electrical plug of claim 2, wherein said notch extends around a portion of a circumference of said removable ground prong.

5. The electrical plug of claim 1, wherein said weakened portion is positioned between 1/32" and 1/2" from said body when said removable ground prong is seated in said threaded ground connector.

6. An electrical plug comprising:

a body;

a connector disposed in said body;

a removable prong having a first end and a second end, wherein said first end is adapted to engage the connector and the second end is adapted to engage an outlet receptacle; and wherein said removable current-carrying prong includes a weakened portion positioned near said first end and outside said body when said removable ground prong is seated in said ground connector.

7. The electrical plug of claim 6, further comprising at least one additional prong.

8. The electrical plug of claim 6, wherein said removable prong is secured in said connector by an interference fit connection.

9. The electrical plug of claim 6, wherein said removable prong is secured in said connector by a pin that engages the removable prong.

10. The electrical plug of claim 6, wherein said removable prong includes a threaded portion that engages corresponding threads on the connector.

11. The electrical plug of claim 6, wherein said weakened portion is a notch.

12. The electrical plug of claim 11, wherein said notch extends around an entire circumference of said removable prong.

13. The electrical plug of claim 11, wherein said notch extends around a portion of a circumference of said removable prong.

14. The electrical plug of claim 6, wherein said weakened portion is positioned between about 1/32" and 1/2" from said body when said removable prong is seated in said connector.

15. An electrical plug comprising:

a body;

a first current-carrying prong;

a second current-carrying prong;

a threaded ground connector disposed in said body;

a removable ground prong having a first end and a second end, wherein said first end includes a threaded portion adapted to engage the threaded ground connector and the second end is adapted to engage a ground receptacle; and wherein said removable ground prong includes a weakened portion in the form of a notch positioned near said first end and outside said body when said removable ground prong is seated in said threaded ground connector.

16. The electrical plug of claim 15, wherein said notch extends around an entire circumference of said removable ground prong.

17. The electrical plug of claim 15, wherein said notch extends around a portion of a circumference of said removable ground prong.

18. The electrical plug of claim 15, wherein said weakened portion is positioned between about 1/32" and 1/2" from said body when said removable ground prong is seated in said threaded ground connector.

19. A current carrying prong, comprising:

a first end for engaging a ground connector in an electrical plug, said first end including a threaded portion for engaging corresponding threads in the ground connector;

a second end for engaging a ground receptacle in an electrical outlet; and a weakened portion positioned near said first end such that when said prong is seated in the ground connector, said weakened portion is outside of the electrical plug.

20. The current carrying prong of claim 19, wherein said weakened portion is in the form of a notch.

* * * * *